United States Patent [19]

Fletcher

[11] 4,083,348

[45] Apr. 11, 1978

[54] BOWSTRING DRAW AND TRIGGER RELEASE APPARATUS

[76] Inventor: James D. Fletcher, P.O. Box 218, Bodfish, Calif. 93205

[21] Appl. No.: 727,055

[22] Filed: Sep. 27, 1976

Related U.S. Application Data

[63] Continuation-in-part of Ser. No. 609,293, Sep. 2, 1975, Pat. No. 4,022,181.

[51] Int. Cl.[2] ..... F41C 19/00

[52] U.S. Cl. ..... 124/35 A

[58] Field of Search ..... 124/35 A, 31, 35 R, 124/24 R, 23 R, 41 R, 41 A

[56] References Cited

U.S. PATENT DOCUMENTS

| | | | |
|---|---|---|---|
| 3,916,868 | 11/1975 | Wolfe | 124/35 A |
| 3,929,120 | 12/1975 | Barner | 124/35 A |

*Primary Examiner*—William R. Browne

*Attorney, Agent, or Firm*—Michael A. Painter

[57] ABSTRACT

A bowstring draw and trigger release for use with conventional archery bows and the arrows used therewith. The bowstring draw and trigger apparatus provides means for drawing a bowstring taut and releasing same to project the arrow upon the triggering of the apparatus. The bowstring draw and trigger release utilizes a looped draw cord which is disposed about the bowstring and secured by a pivotally mounted holding member. The holding member pivots about a fixed shaft, an end thereof being coupled to the trigger of the apparatus. Actuation of the trigger causes the rotation of a directly coupled member which engages the holding member causing same to rotate forwardly allowing the loop to slide therefrom and thereby release the bowstring. There is a coupling member that directly slidably couples the trigger with the holding member. The respective ends of the coupling member are received between flanges of the trigger and the holding member.

4 Claims, 6 Drawing Figures

BOWSTRING DRAW AND TRIGGER RELEASE APPARATUS

This application is a continuation-in-part of my copending application designated as Ser. No. 609,293 filed Sept. 2, 1975, now U.S. Pat. No. 4,022,181.

BACKGROUND OF THE INVENTION

1. Field of the Invention

The present invention generally relates to archery devices and, more particularly, to those devices used to draw and release a bowstring.

2. Prior Art

The prior art discloses a number of bowstring pull and trigger release mechanisms which are utilized to assist archers in pulling and holding the bowstring of a conventional bow in tensioned or taut relationship with the triggering mechanism being used to release the bowstring and thereby project the arrow in a forward direction. One of the problems which is inherent in the release of a bowstring arises from the characteristics of the bowstring when it is suddenly released and allowed to return to its normal untensioned position in the bow. Once the bowstring is released, the bowstring will produce side pressure with twisting being a consequent result thereof. Arrows which are projected from a twisting bowstring do not travel in the direction intended due to the deflection caused by the side pressure and twisting thereby resulting in poor accuracy in the aim and trajectory of the arrow.

A specific device disclosed by the prior art utilizes a self-contained bowstring draw and trigger release. The device disclosed by the prior art employs a holding member which is used to temporarily secure a loop which holds the bowstring in a taut position. A trigger which pivots about a fixed shaft is totally independent of the holding member and contacts the holding member in a manner which has conventionally been designated as a sear. The trigger is urged against a resilient spring, a projection of the trigger preventing the holding member from rotating under the force of the tensioned bowstring. When the trigger is pivoted, the projection thereof releases the holding member thereby permitting the bowstring to return to its untensioned position and thereby launching the arrow. One of the problems inherent in this type of device is the high forces imposed on the trigger projection and holding member, i.e., the sear elements. The contacting surfaces are continually worn under the effect of the bowstring tension thereby deforming the profile of the contacting members, the eventual result thereof being the inoperability of the device. Another deleterious effect resulting from the use of a sear mechanism arises from the increase in pressure as the trigger is moved to its released position. As the area of the contacting interface of the sear contracts during the movement of the trigger, the ability to smoothly and properly release the bowstring is reduced.

The problems associated with the devices disclosed by the prior art are substantially resolved by the present invention. The present invention eliminates the sliding engagement of a sear and substitutes in place thereof a series of coupled, rotatable members which will provide for the smooth release of the bowstring and thereby substantially eliminates unnecessary wear on the component parts thereof.

SUMMARY OF THE INVENTION

The present invention comprises a mechanism used for drawing and releasing a bowstring to provide for accurate projection of an arrow. The present invention bowstring draw and trigger release apparatus is adapted to fit within the hand of an archer and provides for appropriate orientation thereof to allow the archer to release the bowstring by activating a triggering mechanism. A fixed loop is disposed about the bowstring and secured to a holding member in a manner which will permit the bowstring to be drawn to a cocked position. The trigger of the present invention is pivotally mounted in the same plane as the holding member, the rotation of the trigger being fixed in one direction and resiliently urged in the other. The trigger is coupled to the holding member in a manner which permits the bowstring to be released in a smooth manner.

The trigger of the present invention is mechanically coupled to the holding member in a manner which will only permit the bowstring to be released through the intentional depression of the trigger. The mechanical coupling intermediate the trigger and the bowstring holding member directs the force imposed by the bowstring in a direction which reinforces the holding position of the trigger. Once the trigger is depressed, the force of the bowstring is used to properly sequence the rotation of the release elements to provide for a smooth release and disengagement of the bowstring.

It is therefore an object of the present invention to provide an improved bowstring draw and trigger release apparatus.

It is another object of the present invention to provide a draw and trigger release apparatus which uses a directly coupled trigger and release mechanism.

It is yet another object of the present invention to provide a bowstring draw and trigger release apparatus which provides for selective release of the bowstring.

It is still yet another object of the present invention to provide a bowstring draw and release apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
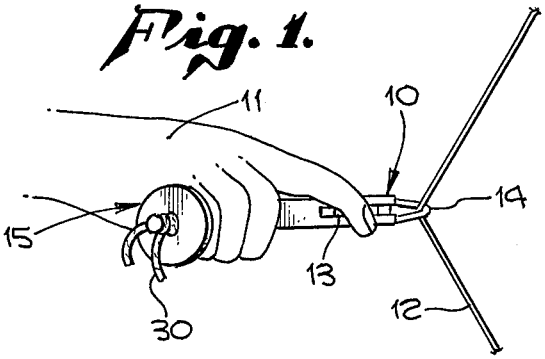
FIG. 1 illustrates a perspective view of an archer's hand on the trigger release of a bowstring draw and trigger apparatus in accordance with the present invention.

The present invention can be best understood by reference to FIG. 1 wherein a preferred form of the present invention is shown being held in the right hand of an archer, the form of the present invention bowstring trigger and draw apparatus being generally designated by the reference numeral 10. The present invention apparatus 10 is being held in hand 11, the pictorial illustration shown in FIG. 1 showing bowstring 12 in the cocked position. The index finger of the archer's hand 11 rests on the trigger assembly 13. In a form of the present invention, bowstring draw cord 14 passes about bowstring 12 and is slidably coupled to a holding member which will be described in detail hereinbelow. Handle 15 is molded to comfortably fit in hand 11 irrespective of whether the archer is right handed or left handed.

Figure 2:
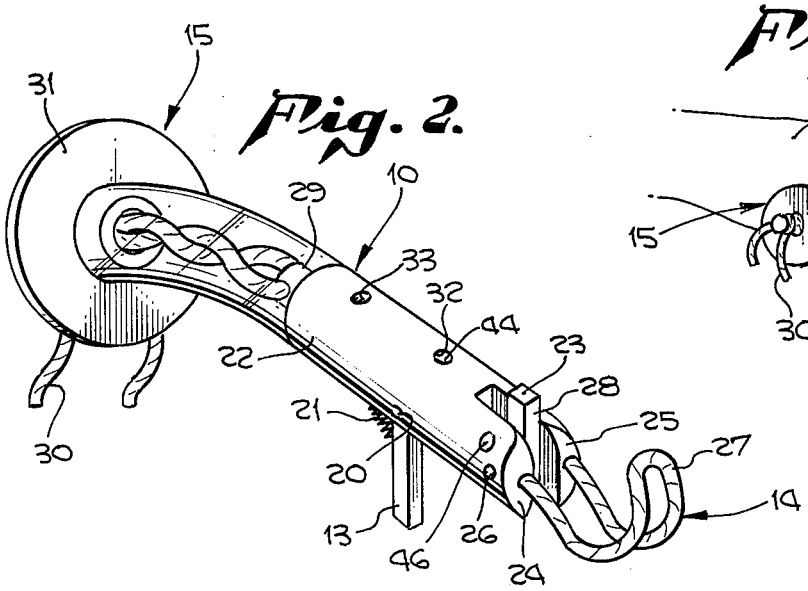
FIG. 2 illustrates a front perspective view of the present invention bowstring draw and trigger apparatus.

Referring now to FIG. 2, a perspective view of the bowstring draw and trigger release apparatus 10 is shown. Trigger assembly 13 is journaled about shaft 20 by suitable bearings and is rotatable about shaft 20 limited only by restraints which will be discussed hereinbelow. Resilient spring 21 is interposed between body portion 22 and spring 13 to provide for a resilient force to urge trigger assembly 13 to return to its initial state after it has been depressed. Each end of the bowstring draw cord 14 is inserted into apertures of flanges 24 and 25 of body portion 22 and secured therein by conventional set screws 26 or other suitable securing means. Draw cord 14 typically comprises a strong and flexible cord of approximately 3/32 inches in diameter and is made of nylon, waxed cotton or other suitable material.

Holding member 23 is disposed intermediate flanges 24 and 25 of body portion 22 and is coupled to trigger assembly 13 in a manner which will be described in detail hereinbelow. As shown in FIG. 1, bowstring 12 is drawn into its cocked position by having bowstring draw cord 14 disposed thereabout, the terminating loop 27 of draw cord 14 being placed about holding member 23 and resting against face 28 thereof. In a typical form of the present invention, body portion 22 is cylindrical and includes an axially disposed projecting eye bolt 29 which includes means for receiving cord 30 therethrough. Hand supporting or abutting shield 31 terminates the body portion 22, shield 31 being secured to body portion 22 by suitable cord 30. The section of body portion 22 adjacent shield 31 is preferably fabricated of clear plastic, although any suitable material can be used. Cord 30 is fixedly attached to body portion 22 by projecting eye bolt 29, cord 30 being twisted within the interior of body 22 and fixedly tied in a manner shown in FIG. 1.

Figure 3:
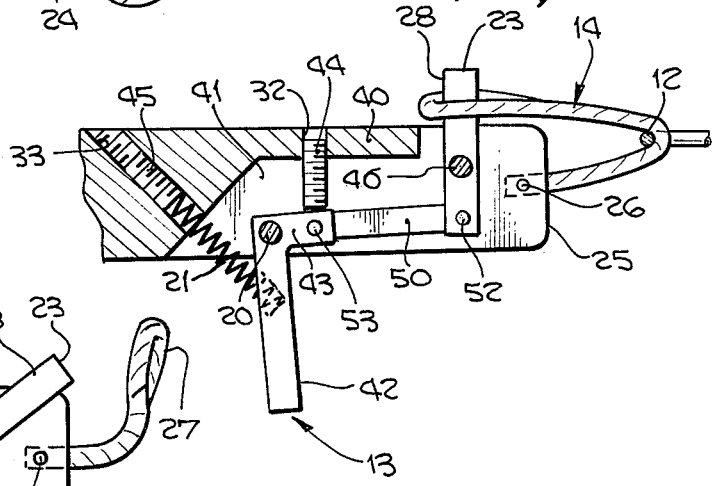
FIG. 3 illustrates a side elevation, partial cross-sectional view of the present invention bowstring draw and trigger release apparatus with the bowstring in the drawn and held position taken through line 3—3 of FIG. 2.
Figure 4:
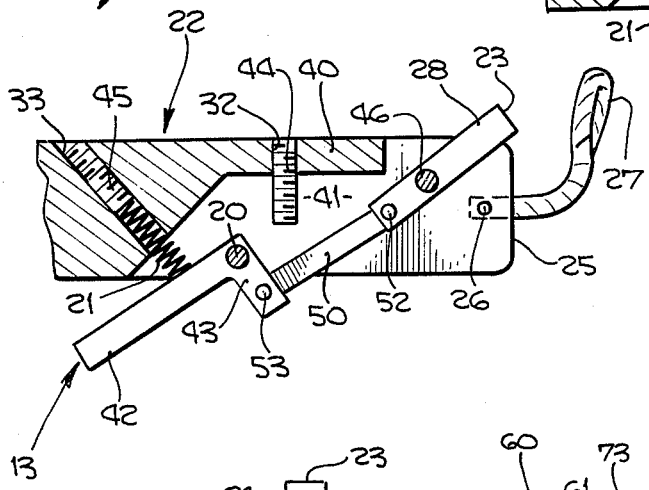
FIG. 4 illustrates a side elevation, partial cross-sectional view of the present invention bowstring draw and trigger release apparatus following the release of the bowstring taken through line 4—4 of FIG. 2.

The operation of the present invention bowstring draw and trigger release apparatus 10 can be best seen by reference to FIG. 3 and FIG. 4 which illustrate side elevation, cross-sectional views prior to and after releasing of bowstring 12. During the cocking of bowstring 12, bowstring draw cord 14 is disposed about bowstring 12, terminating loop 27 resting against face 28 of holding member 23. Face 28 is disposed at any suitable angle with respect to the force imposed by draw cord 14, the angle thereof insuring that the draw cord 14 will not inadvertently slip from holding member 23 and thereby cause premature release of an arrow. It is also to be noted that a form of the present invention can dispense with bowstring draw cord 14 and provide for direct abutment of bowstring 12 upon face 28 of holding member 23.

Body portion 22 is substantially cylindrical in shape and terminates at flanges 24 and 25 as shown in FIG. 2. Center spine 40 lies intermediate flanges 24 and 25 and extends rearwardly away from flanges 24 and 25. Spine 40 of the body portion 22 extends downwardly to the bottom of body portion 22 defining cavity 41 within which trigger assembly 13 and holding member 23 are disposed. Trigger assembly 13 is journaled about shaft 20 on suitable bearings. Trigger assembly 13 comprises trigger handle 42 and perpendicular extension 43, shaft 20 being disposed through an aperture in trigger assembly 13 at the intersection of trigger handle 42 and extension 43. An aperture 32 is disposed through spine 40 substantially in the vicinity of the terminus of extension 43. Set screw 44 is threaded into aperture 32 and adjustably restrains the counterclockwise rotation of trigger 13 about shaft 20. Set screw 44 provides for the suitable position of holding member 23 to insure that the force imposed by a cocked bowstring 12 will not cause inadvertent release of an arrow. A second aperture 33 is disposed obliquely into spine 40. Spring 21 is disposed into aperture 33 and urged against trigger handle 42. To secure the opposite end of spring 21, set screw 45 is threaded into aperture 33 and is placed in abuttment with spring 21. A combination of set screw 44 and resilient spring 21 thereby restrain the clockwise and counter-clockwise rotation of trigger 13.

Figure 5:
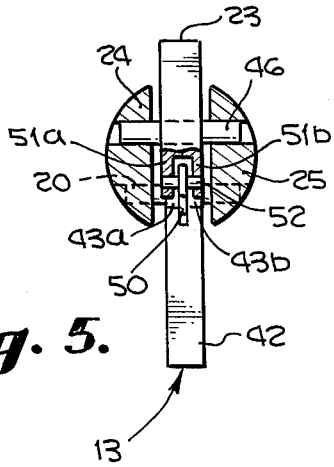
FIG. 5 illustrates a cross-sectional, front elevation view of the present invention taken through line 5—5 of FIG. 2.

Holding member 23 is journaled about shaft 46 by suitable bearings and is rotatably held intermediate flanges 25 and 26 as shown in FIG. 2. As can be seen in FIG. 3, clockwise rotation of holding member 23 will permit release of bowstring draw cord 14. Coupling member 50 is journaled intermediate trigger extension 43 of trigger assembly 13 and lower terminus 51 of holding member 23. As can be seen in FIG. 5, a symmetrically disposed cavity is formed in the lower terminus of holding member 23 thereby forming flanges 51*a* and 51*b*. Coupling 50 is disposed between flanges 51*a* and 51*b* of holding member 23 and journaled about shaft 52. In a like manner, a symmetrical cavity is disposed into trigger extension 43 thereby forming a pair of flanges 43*a* and 43*b*. Coupling 50 is disposed intermediate flanges 43*a* and 43*b* and journaled about a shaft 53 which is connected intermediate 43*a* and 43*b* of trigger 13.

As set forth hereinabove, FIG. 3 illustrates the present invention 10 after bowstring 12 has been withdrawn into the cocked position. Several of the objectives of the present invention are to provide a smooth release of bowstring 12 and to prevent inadvertent release of an arrow as a result of the forces imposed by a taut bowstring 12. The assembly formed by trigger assembly 13, coupling 50 and holding member 23 achieve the stated objectives. Resilient spring 21 is in a normal state of compression and therefore urges trigger extension 23 against set screw 44 in the absence of any force imposed by the archer against trigger handle 42. As shown in FIG. 3, the axis of coupling 50 lies intermediate shafts 52 and 53. In the quiescent state, the force imposed upon face 28 of holding member 23 will be directed through coupling 50, the line of force being substantially along the axis of coupling 50. Set screw 44 is adjusted to provide that shaft 53 is slightly higher than shaft 20, therefore the force directed along the axis of coupling 50 reinforces the force of spring 21. In order to release bowstring 12, trigger assembly 13 is rotated clockwise by depressing trigger handle 42 until the force transmitted through coupling 50 passes through the center of shaft 20 and commences to oppose the force of spring 21.

Referring now to FIG. 4, the ability of the present invention bowstring draw and trigger release apparatus 10 to smoothly release bowstring 12 can be best seen. Another object of the present invention is to provide for the smooth release of bowstring 12 without the need for a sear or other release mechanism which requires the sliding and frictional engagement of elements. In the orientation of the present invention shown in FIG. 4, the bowstring 12 is released by urging trigger handle 42 against the resilient force imposed by spring 21. As stated, by causing trigger 13 to rotate clockwise about shaft 20, trigger extension 43 will cause the terminus of the coupling 50 which is connected thereto to be drawn downwardly. Since holding member 23 is journaled about shaft 46, the downward movement of coupling 50 will cause holding member 23 to be rotated in a clockwise direction in the manner shown in FIG. 4. As soon as the angle between face 28 and the path of the flight of the arrow becomes less than 90°, loop 27 of draw cord 14 will be caused to slip from holding member 23 thereby causing the release of bowstring 12. After the archer releases trigger assembly 13, the resilient urging of spring 21 will cause trigger 13 to rotate counter-clockwise about shaft 20 and return to its initial state. Set screw 44 provides the adjustable stop for trigger extension 43 as can be best seen in FIG. 3. The adjustment provided by set screw 44 will terminate the counter-clockwise rotation of trigger 13 and the upward movement of coupling 50. Since holding member 23 is moveable only by rotating about shaft 46, the quiescent state of holding member 23 is as shown in FIG. 3, i.e., vertical. Set screw 44 can be adjusted to properly position holding member 23 in a manner which will insure that bowstring draw cord 14 will remain stationary against face 28 while bowstring 12 is being withdrawn to the cocked position.

Figure 6:
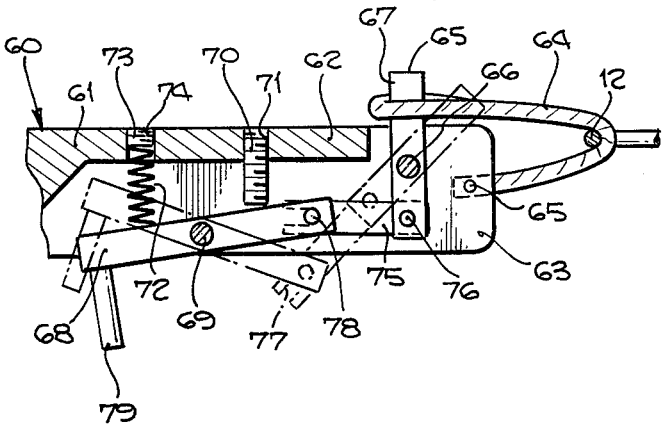
FIG. 6 illustrates a side elevation, partial cross-sectional view of another form of the present invention bowstring draw and trigger release apparatus shown in full line the holding or cocked relationship to the bowstring and in dashed lines the released position.

Another form of the present invention can be best seen by reference to FIG. 6 wherein the form of the present invention bowstring draw and trigger release shown therein is generally designated by the reference numeral 60. The form of the present invention shown in FIG. 6 comprises a body 61 which is typically cylindrical. Body 61 includes spine 62 along the upper portion thereof which defines a pair of flanges similar to that shown in FIG. 2, the cross-sectional view shown in FIG. 6 illustrating only a single flange 63. A bowstring draw cord 64 is secured within flange 63 by a set screw 65 or other suitable securing member. Draw cord 64 is disposed about bowstring 12 in the manner described in connection with FIG. 3. Holding member 65 is journaled about shaft 66 by suitable bearings, face 67 of holding member 65 being adapted to receive draw cord 64 when bowstring 12 is being withdrawn into the cocked position. Trigger 68 is journaled about shaft 69, the alternate position of trigger 68 being defined by set screw 70 mounted in aperture 71 and the resilient force imposed by helical spring 72. As can be seen in FIG. 6, helical spring 72 is adjustably mounted through the use of set screw 73 which is disposed into threaded aperture 74.

Trigger 68 is coupled to holding member 65 through the use of coupling member 75. Coupling member 75 pivots about shaft 76 in the same manner as was described in connection with coupling member 50 shown in FIG. 3, FIG. 4 and FIG. 5. The other end of coupling member 75 has a slot 77 disposed therein. The end of trigger 68 which is coupled to member 75 includes a set of parallel spaced flanges such as shown in FIG. 5. The end of coupling member 75 having slot 77 disposed therein is set between the parallel flanges of trigger 68 and is slidably joined thereto by disposing shaft 78 into slot 77.

The form of the present invention shown in FIG. 6 utilizes the same principal as is described in connection with FIGS. 1 – 5, inclusive. Bowstring 12 is to be drawn by draw cord 64. Holding member 65 is placed in the locked position whereby an axis drawn through shafts 76 and 78 through coupling member 75 lies on the opposite side of shaft 69 from trigger contact 79. Although trigger contact 79 is shown in an elongated form, it is within the scope of the present invention to reduce the length thereof to any suitable length. As can be seen from the full, unbroken lines shown in FIG. 6, the force imposed by bowstring 12 will reinforce the locking mechanism of trigger 68, holding member 65 and coupling member 75. The release of bowstring 12 and the relative movement of the elements of the form of the present invention shown in FIG. 6 can be seen in broken lines. The releasing force is urged against trigger contact 79 which will cause helical spring 72 to be compressed. The coupling between trigger 68 and coupling 75 at shaft 78 will rotate clockwise until the vectorial force drawn through shaft 78 from shaft 76 will schematically pass through shaft 69 thereby causing coupling member 75 to rotate counter-clockwise. Slot 77 permits shaft 78 to slidably move thereby negating any undue mechanical stress on the coupled elements. Once the vectorial force has caused the coupled elements to unlock, draw cord 64 will be released from holding member 65 thereby releasing bowstring 12.

The present invention bowstring draw and triggering release apparatus provides simplified and inexpensive means for smoothly releasing the bowstring of an archery bow. Since there is a direct coupling between the triggering and release mechanism of the present invention, the triggering action of the archer is smooth and continuous thereby obviating the deleterious effect which results in the use of a release mechanism having a sear which separates the trigger from the release elements. Since the coupling between the releasing member and the cam or trigger are journaled with suitable bearings, there is no excess wear of any element of the triggering and release members of the present invention. Although it is clear that only a few embodiments of the invention have been illustrated and described, it will be apparent to those having skill in the art that various modifications may be made therein without departing from the scope of the present invention.

I claim:

1. A bowstring draw and release apparatus comprising:

(a) a housing comprising a spine and a pair of flanges having inner walls aligned in uniformly parallel spaced relation to one another, the flanges depending from said spine defining a U-shaped cavity between the inner walls of said flanges with the cavity positioned at the end of the housing;

(b) a bowstring draw cord extending between said flanges of said housing and including a terminal loop, said bowstring draw cord adapted to be disposed about and draw a bowstring;

(c) a holding member pivotally secured between the inner walls of said flanges for movement between said first and second positions for respectively holding and releasing the terminal loop of said draw cord whereby a bowstring may be drawn and released;

(d) trigger means for releasing a bowstring, the trigger means being pivotally coupled between the inner walls of said flanges, and lying in the same plane as said holding member said trigger means being moveable between first and second positions consistent with the first and second positions of the holding member, said trigger means comprising a trigger member having first and second ends, said trigger member being journaled between the inner walls of said flanges intermediate said first and second ends and having its longitudinal axis extending between the first and second ends thereof, the second end of said trigger member comprising first and second parallel flanges, said holding member having a first end extending beyond said housing and a second end lying intermediate said inner walls, the second end of said holding member comprising first and second flanges;

(e) limit stop means coupled to said spine intermediate said inner walls and extending into said cavity for limiting the pivotal movement of said trigger member at the first position of movement thereof;

(f) resilient means coupled to said spine and extending into said cavity for contacting said trigger member and urging said trigger member to return from the second position to the first position of movement thereof; and (g) a coupling means for directly, slidably coupling said trigger means at a first end thereof to said holding member at a second end thereof, whereby the pivotal movement of said trigger means is transmitted to said holding means through a slot in said coupling means by said coupling member to pivot said holding member between the first and second positions thereof, first ends of said coupling member being slidably coupled intermediate the first and second flanges of said trigger member, the second member of said coupling member being journaled intermediate to the first and second flanges of said holding member.

2. A bowstring draw and release apparatus as defined in claim 1 wherein said resilient means comprises a helical spring adapted to urge said trigger member and holding member from the second position of movement to the first position of movement thereof.

3. A bowstring draw and release apparatus as defined in claim 2 wherein the first position of said holding member defines the position where a bowstring is drawn, said coupling means having an axis which extends intermediate the journaled coupling to said holding member and the slidable coupling to said trigger member, the projection of said axis being directed to the side of said trigger member adjacent said helical spring whereby a force imposed on said holding member by a drawn bowstring prohibits said holding member from moving from the first to the second position of movement thereof.

4. A bowstring draw and release apparatus as defined in claim 5 wherein said holding member is caused to move from the first to the second position thereof by moving said trigger member against the force of said resilient means until the projection of the axis of said coupling means is directed to the side of said trigger member opposite said resilient means.

* * * * *